United States Patent [19]

Anderson et al.

[11] Patent Number: 4,640,287

[45] Date of Patent: Feb. 3, 1987

[54] RELEASABLE FASTENING MEANS AND METHOD FOR CLOTHING ITEMS, PARTICULARLY CAPS, BRASSIERS, AND NURSING BRASSIERS

[76] Inventors: Raymond G. Anderson; Doris E. Anderson, both of 206 N. Sharmin St., Ankeny, Iowa 50021

[21] Appl. No.: 641,262

[22] Filed: Aug. 16, 1984

[51] Int. Cl.[4] ..... A41C 3/04

[52] U.S. Cl. ..... 128/460

[58] Field of Search ..... 128/460; 2/197; 24/303

[56] References Cited

U.S. PATENT DOCUMENTS

| | | | |
|---|---|---|---|
| 2,102,769 | 2/1952 | Meares | 2/31 |
| 2,389,298 | 11/1945 | Ellis | 24/303 |
| 2,666,919 | 1/1954 | Spangard | 2/42 |
| 2,748,771 | 6/1956 | Richards | 128/280 |
| 3,109,431 | 1/1963 | Jefferson | 128/472 |
| 3,203,424 | 8/1965 | Garutso | 128/492 |
| 3,425,420 | 2/1969 | Steinberger | 128/460 |
| 3,714,670 | 2/1973 | Pollack et al. | 2/197 |
| 4,222,387 | 9/1980 | Tetu | 128/460 |
| 4,390,024 | 6/1983 | Williams | 128/460 |

FOREIGN PATENT DOCUMENTS

| | | | |
|---|---|---|---|
| 221990 | 6/1958 | Australia | 128/460 |
| 627409 | 9/1961 | Canada | 128/460 |

OTHER PUBLICATIONS

Gersham Publication, (Journal of AMA), vol. 168, No. 7, 10-19-1958.

*Primary Examiner*—Doris L. Troutman

*Attorney, Agent, or Firm*—Zarley, McKee, Thomte, Voorhees & Seas

[57] ABSTRACT

A releasable fastening means and method for clothing items such as conventional caps, brassieres, and nursing brassieres, having portions for abutting securement to a user which includes a movable portion attached to at least one end or along one side to the clothing item and having at least one releasable side or end which is releasably attachable to a receptacle portion which is also attached to the clothing item. The movable portion and receptacle portion co-act to allow fastening and unfastening and securement of the clothing item to the user without hook, button, snaps, zippers, latches, buckles, or the like. The releasable fastening means can be easily fastened and unfastened with one hand and does not require intricate and cumbersome positioning or alignment of the portions. The releasable fastening means can take on a variety of embodiments and can be applied to a variety of clothing items. In addition, the releasable fastening means has inherent size adjustability.

2 Claims, 7 Drawing Figures

RELEASABLE FASTENING MEANS AND METHOD FOR CLOTHING ITEMS, PARTICULARLY CAPS, BRASSIERS, AND NURSING BRASSIERS

BACKGROUND OF THE INVENTION

1. Field of the Invention

This invention relates to a releasable fastening means for clothing items, more particularly, a releasable fastening means for caps, brassieres, and nursing brassieres which allows fastening and unfastening and securement of the clothing item to a user without hooks, buttons, snaps, zippers, latches, buckles, or the like.

2. Problems in the Art

Conventional clothing items having portions which must be attached together or must be used to secure the item to the user have utilized a variety of mechanical devices to facilitate this fastening. Hooks, buttons, snaps, zippers, latches, buckles, and the like are prime examples of this hardware. Choice of a mechanical fastener such as this is based upon considerations of function, operation, economy, strength, purpose, ease of operation, and style or aestheticness. For example, most caps have adjustable snap fasteners whereas most brassieres have hook and eye combinations or some kind of a button, hook, or snap.

Although it is acknowledged that advances have been made with regard to these mechanical fasteners for these particular clothing items, they still operate in the same general manner with the same general structure similar to the way they have existed for many years.

The standarized use of conventional mechanical fasteners throughout an industry for a particular clothing item is based upon a determination of what seems to be most appropriate for that particular item.

Sometimes, however, there are real needs for alternative means of fastening to satisfy or solve special considerations involved with regard to a particular clothing item. One specific example would be the conventional brassiere, wherein the traditional fastening means involves a hook and eye configuration, or multiple hooks and eyes. Fastening and unfastening is cumbersome and difficult for the user, especially if the fastening is in the back.

Likewise, a conventional baseball-type cap traditionally utilized an elastic band for fitting to various sized heads, and recently has implemented various types of adjustment or securement-type straps in the back of the headband of the hat. Most of these involve either an adjustable belt and buckle configuration, or a multi-holed snap configuration. In both cases, it is cumbersome and time consuming to adjust the fit of the cap.

Additionally, it would many times be much more convenient to be able to fasten and unfasten these clothing items using just one hand, rather than two hands. A nursing brassiere conventionally uses snaps or latches for the flaps, which generally require the use of two hands to either unfasten or fasten. This is cumbersome and inconvenient if the child is being held, therefore it would be advantageous to be able to quickly, conveniently and easily operate the fastening means with one hand.

Handicapped or persons limited in mobility or dexterity would also benefit from this type of fastening means.

It is therefore a primary object of this invention to provide a releasable fastening means for clothing items which improves upon the art and solves problems in the art.

A further object of this invention is to provide a releasable fastening means for clothing items which can be fastened and unfastened with one hand.

Another object of this invention is to provide a releasable fastening means for clothing items which does not utilize mechanical or interlocking structure for fastening.

A further object of this invention is to provide a releasable fastening means for clothing items which has inherent adjustability.

Another object of this invention is to provide a releasable fastening means for clothing items which is convenient, economical, and easy to use.

A further object of this invention is to provide a releasable fastening means which is easily replaceable.

These and other features, objects and advantages of the invention will become apparent with reference to the accompanying specification.

SUMMARY OF THE INVENTION

This invention utilizes a releasable fastening means for clothing items, particularly caps, brassieres, and nursing brassieres, having a movable portion and a receptacle portion for allowing the fastening, unfastening and securement of the clothing item to the user without hooks, buttons, snaps, zippers, latches, buckles, or the like. The movable portion has at least one side or end attached to the clothing item and has another side or end which is releasably attachable to the receptacle portion which has at least one side or end attached to the clothing item. The releasable attaching ability of the movable portion to the receptacle portion is accomplished without mechanical interlocking or straps and buckles. It is applicable to the fastening and securing of the clothing item to itself or to the user, or to creating an adjustable sizing for the clothing item so it can easily be applied to different persons.

DETAILED DESCRIPTION OF THE PREFERRED EMBODIMENTS

Figure 1:
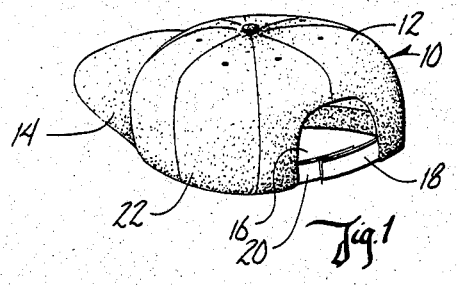
FIG. 1 is a rear perspective view of a first embodiment of the invention.
Figure 2:
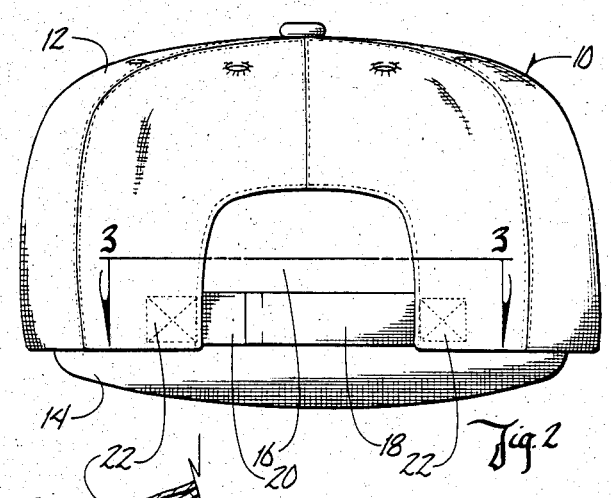
FIG. 2 is a front elevational view of the embodiment of the invention shown in FIG. 1.

In reference to the drawings, and particularly FIG. 1, there is shown a releasable fastening means for a clothing item according to a first embodiment of the invention, a standard cap 10. Cap 10 includes a bowl portion 12 and a bill portion 14. An opening 16 is formed in the back of bowl portion 12. A releasable fastening means is positioned across opening 16 and consists of a movable portion 18 and a receptacle portion 20. By referring to FIG. 2, the exact position of movable portion and receptacle portion 18 and 20 can be seen. Both are elongated strap-like portions extending and overlapping one another generally along a circumferal line defined by the headband of bowl portion 12 of cap 10. Movable portion 18 and receptacle portion 20 are attached to cap 10 by any conventional means. As shown in FIG. 2 by the dashed lines they can be attached by sewing.

Figure 3:
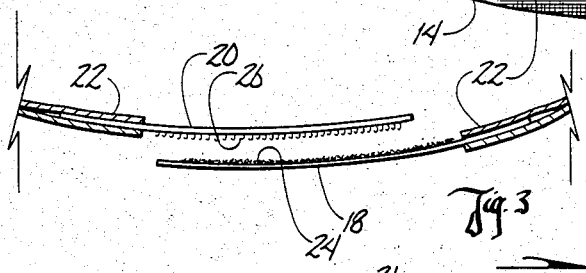
FIG. 3 is a partial cross-sectional view taken along line 3—3 of FIG. 2.
Figure 4:
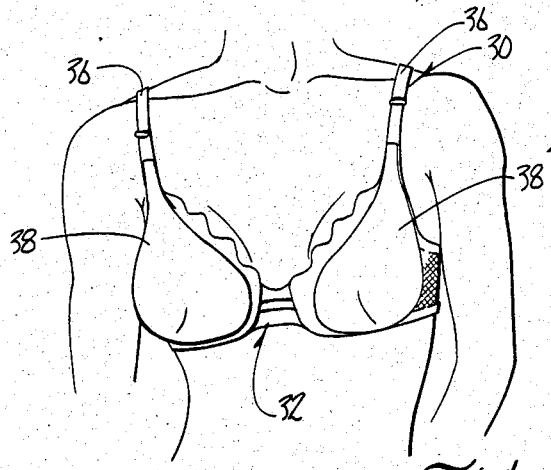
FIG. 4 is a front view of a second combined embodiment of the invention.
Figure 5:
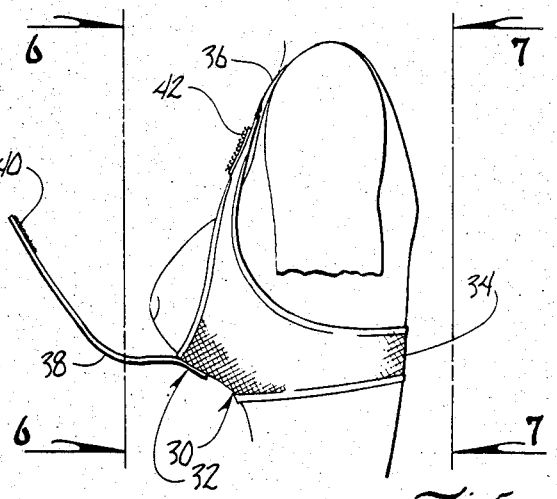
FIG. 5 is a side view of the second embodiment of the invention.
Figure 6:
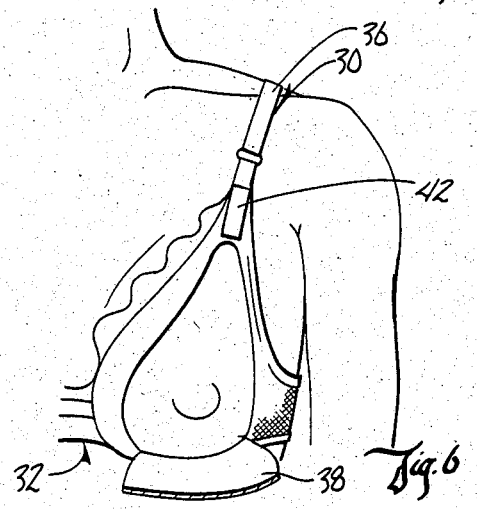
FIG. 6 is a partial sectional view of the second embodiment of the invention.

FIG. 3 shows one embodiment of the means for releasable attachment of movable portion 18 to movable portion 20. Movable portion 18 has multiple, densely positioned loop members 24 secured to its inward facing surface. Receptacle portion 20 has multiple, densely packed and positioned hook members 26 secured to its outer facing surface. By bringing loop members 24 in contact with hook members 26, a secure fastening is accomplished. By simply grasping movable portion 18 and applying a pulling-away force, loop members 24 can be separated from hook members 26 for unfastening.

Because of the numerous hook and loop members along the lengths of both movable and receptacle portions 18 and 20, portions 18 and 20 can be fastened to one another at various positions so that the circumference of the headband can be modified or adjusted by simply fastening movable portion 18 to receptacle portion 20 at a different position.

The movable and receptacles portions 18 and 20 can be fastened either before placement of the hat on the user's head or after. The ease of operation for fastening and unfastening allows the user to do so with one hand, so that even if unfastened when put upon the user's head, the user could grasp the hat with one hand and fasten those portions with the other to the correct position.

Hook and loop members 24 and 26 are not subject to the common breakage, misplacement or loss, or cumbersome alignment problems of fasteners such as buttons, snaps, buckles, hook-and-eyes, etc. They are also easily and economically replaceable.

By referring to FIGS. 4–7, a second embodiment of the invention can be seen. This embodiment actually combines two additional embodiments of the invention.

A brassiere 30 is shown having a front portion 32, a back supporting portion 34 and shoulder straps 36. Additionally, as can be seen more clearly in FIG. 5, brassiere 30 has flap portions 38 which are used for nursing. Flap portions 38, in one embodiment, are secured to the lower part of front portion 32 and have a plurality of loop member 40 attached at its upper end on its inward facing surface.

A matching plurality of hook members 42 are secured to the upper part of front portion 32 or strap portions 36 of brassiere 30 and serve to receive and secure loop members 40 of flap portions 38 to close flap portions 38.

Likewise, by separating loop members 40 from hook members 42, the flap portions 38 can be unfastened to allow nursing. If desired flap 38 may have a hand grasping tab positioned opposite loop members 40. This can be seen in FIG. 6.

Figure 7:
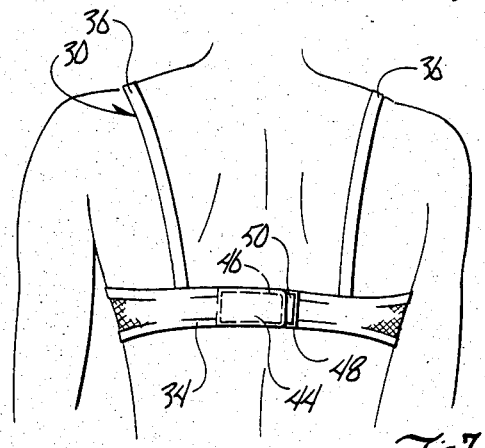
FIG. 7 is a rear view of the second embodiment of the invention.

Additionally, by referring to FIG. 7, it can be seen that the same fastening means can be utilized for securing the back supporting portion of brassiere 30 to the user. A movable portion 44 has loop members 46 (not shown) on its inner-facing surface whereas a receptacle portion 48 has a plurality of hook members 50 (not shown) on its outer facing surface. By overlapping and bringing loop members 46 in contact with hook members 50, movable portion 44 can be releasably secured to receptacle portion 48 and thereby secure brassiere 30 to the user. The fastening means could also be applied to front fastening brassieres. Similarly, a tab may be positioned opposite loop members 46 on movable portion 44.

The fastening means comprising the hook members and loop members described above is generally known as a VELCRO® fastener commercially available under the trademark "VELCRO" from the Velcro Corp., New York. It is to be understood that the attachment means could also take on different embodiments as described below.

In the first embodiment of the invention, as depicted in FIGS. 1–3, loop members 24 and hook members 26 could be replaced by magnetic elements of opposite magnetic polarity. Such magnetic elements are known in the art and are commercially available and could be affixed to the clothing items by any method known in the art.

Still another embodiment for the releasable fastening means would be to replace loop and hook members 24 and 26 with semi-adhesive material which can be releasably fastened and unfastened and still retain its adhesive qualities. An example of such semi-adhesive is that which is used on Scotch® brand Post-it® Note Pad sheets made by the 3M Company. Likewise, these same alternative embodiments for the fastening means could be substituted for loop and hook members 40 and 42 or loop and hook members 46 and 48 of the embodiments of the invention shown in FIGS. 4–7.

It is also to be understood that the releasable fastening means embodiments described above could also be applied to other embodiments of clothing items. For example, the fastening means for conventional swimsuits or bathrobes could be replaced by any of the fastening means embodiments described herein. Additionally, day jackets could be so secured.

It has thus been shown that the invention achieves at least all of its stated objectives.

It will be appreciated that the present invention can take many forms and embodiments. The true essence and spirit of this invention are defined in the appended claims, and it is not intended that the embodiment of the invention presented herein should limit the scope thereof.

What is claimed is:

1. A nursing brassiere which allows easy but releasable fastening and unfastening of a nursing flap comprising:

a brassiere having breast pockets and having openable and closeable nursing flaps for nursing purposes associated with each breast pocket;

said nursing flaps having a movable portion having at least one side attached to said nursing brassiere;

a pull away attachment means secured to said movable portion for simple pulling release of said flap to expose the breast for nursing and for simple pressing closure of said flaps;

said pull away attachment comprising at least two base pads having a plurality of closely positioned outwardly-extending pile loops of thread-like material attached to one of said pads and having a plurality of closely positioned outwardly-extending pile hook members attached to the other of said pads, so that upon pressing engagement of said pads many of said loops and said hooks engage, one of said pads being attached to said nursing flap and the other being located on said brassiere to allow said pads to engage on pressing closure of said flap.

2. The nursing brassiere of claim 1 wherein said pads are longitudinally oriented to allow vertical adjustment of said flap along the length of said base pads.

* * * * *